United States Patent [19]

Yamauchi

[11] Patent Number: 4,726,307

[45] Date of Patent: Feb. 23, 1988

[54] TWO-NEEDLE CORNER SEWING MACHINE

[75] Inventor: Satomi Yamauchi, Aichi, Japan

[73] Assignee: Mitsubishi Denki Kabushiki Kaisha, Tokyo, Japan

[21] Appl. No.: 900,481

[22] Filed: Aug. 26, 1986

[30] Foreign Application Priority Data

Sep. 3, 1985 [JP] Japan ..... 60-194209

[51] Int. Cl.[4] ..... D05B 19/00; D05B 1/08

[52] U.S. Cl. ..... 112/121.11; 112/163

[58] Field of Search ..... 112/121.11, 121.12, 112/163, 275, 272, 2, 262.1, 155, 121.15, 221

[56] References Cited

U.S. PATENT DOCUMENTS 4,178,862 12/1979 Bianchi et al. ..... 112/121.11
4,195,582 4/1980 Novick et al. ..... 112/275 X
4,359,953 11/1982 Martell et al. ..... 112/121.11
4,403,558 9/1983 Martell et al. ..... 112/121.11
4,526,114 7/1985 Martell et al. ..... 112/121.11 X

FOREIGN PATENT DOCUMENTS 2513179 10/1975 Fed. Rep. of Germany .
2919681 11/1980 Fed. Rep. of Germany .
122590 9/1980 Japan .

*Primary Examiner*—Peter Nerbun
*Attorney, Agent, or Firm*—Sughrue, Mion, Zinn, Macpeak, and Seas

[57] ABSTRACT

A two-needle sewing machine which is switched to one-needle sewing at corners. The number of stitches at the beginning of the corner before the changing of the cloth direction is independently set from the number of stitches afterwards. Multiple corners are accommodated by multiple pairs of numerical switches.

1 Claim, 6 Drawing Figures

TWO-NEEDLE CORNER SEWING MACHINE

BACKGROUND OF THE INVENTION

1. Field of the Invention

This invention relates generally to sewing machines. In particular, it relates to a controller for a two-needle corner sewing machine including a needle bar mechanism capable of sewing either with two needles and with only one of the two needles by stopping the other needle.

2. Background Art

As is taught in the prior art, for example, by Japanese Unexamined Patent Publication No. 55-122590, there is known a means for controlling a type of two-needle corner sewing machine including a needle bar mechanism capable of sewing either with two needles or with only one of the needles, the other being stopped. Shown in FIG. 1 is a two-needle sewing machine 1, specifically the arm bed of the sewing machine, located on a table 2 and powered through a pulley 3. An ordinary needle position detector 4 detects the needle position in order to stop a needle 5 at a lower position. A motor 6 drives the sewing machine 1 through the pulley 3 and is controlled by a pedal 7. Control means 8 controls the sewing machine 1. A lever-like changing means 9 changes the sewing machine 1 to one-needle operation from two-needle operation or conversely to two-needle operation from one-needle operation. The lever-like changing means 9 is rotatably mounted on the sewing machine 1, and is positioned at a neutral position by a neutral return spring (not shown) for a normal operation in which the two-needle mechanism is set. The one-needle mechanism is set when the changing means 9 is rotated to the right or left. The one-needle mechanism for operating the needle 5 on the right side is set when the upper end of the changing means 9 is rotated to the right side against the force of the neutral return spring, and the one-needle mechanism for operating the needle at the left side is set when the upper end of the changing mechanism 9 is rotated to the left side against the neutral return spring. An electromagnet 11 rotates the changing means 9 to the right side, while another electromagnet 12 rotates the changing means 9 to the right side. The magnets 11 and 12 are driven by the control panel 8. A changing means 10 designates the electromagnet 11 or 12 to the driven for a corner sewing operation.

An operating panel 13 sets the number of the different type of the corner portions and the number of the stitches to be sewn in the corner portions since the corner portions are of different types and lengths. As shown in FIG. 2, a number-of-stitches setting means sets the number of stitches to be sewn using one needle at the first corner portion. Additional number-of-stitches setting means 21, 22 and 23 set the numbers of the stitches using only one needle at the second to fourth corner portions. The additional setting means 21, 22 and 23 are constituted of switches. A designating means 24 determines the total operative number of the four number-of-stitches setting means 20 to 23. In this prior art, the designating means 24 is also constituted of a switch.

In the prior art described above, if the sewing pattern shown in FIG. 3 is carried out, the switch of the number-of-stitches setting means 24 shown in FIG. 2 is set to "1" because the number of stitches sewn with one needle is one at the first corner portion (A portion). The number of stitches is duplicated on each side of the corner. Further, the switch 21 in FIG. 2 is set to "3" because the number of stitches with one needle is three at the second corner portion (B portion). Also, the switch 22 is set to "1" for the third corner portion (C portion). For this example, the designating means 24 is set to "3" because the number of corners is three in this example. Further, the changing means 10 is set to the right because all of the one-needle sewing operations are operations with the right needle 5 of the sewing machine 1. Now, the ordinary high speed operation using two needles is carried out before the point 100 in FIG. 3, and is performed by one-directional tread operation of the pedal 7. The needles are stopped at the point 100 in FIG. 3 by returning the pedal 7 to the neutral position.

Next, when a corner sewing signal is generated, the electromagnet 12 operates to rotate the changing means 9 to the right side by the control means 8. Then the control means 8 operates the motor 6 to perform one-needle sewing between the points 100 to 200 during the single period set by the first number-of-stitches setting means 20. The needles are stopped at the point 200. When the direction of the cloth is changed at this point 200 and the pedal 7 is again treaded to the forward direction, one needle sewing is again performed during the single section between the points 200 to 300 set by the first number-of-stitches setting means 20. Then, the control means 8 operates the electromagnet 11 rotating the changing means 9 to the left side, and the sewing is returned to two-needle sewing at the point 300. Two-needle sewing is performed in the section 300 to 400.

When the needles are stopped at the point 400 by positioning the pedal 7 to the neutral position, and the changing means 9 is turned on, sewing is again changed to one-needle sewing, which is performed between the points 400 to 500 during the three periods set by the second number-of-stitches setting means 21. Subsequently, the needle is stopped at the point 500, the direction of the cloth is changed, and then one-needle sewing is performed by the forward direction tread operation of the pedal 7 for the three periods set by the second number-of-stitches setting means 21. Thereafter, the sewing operation is returned to two-needle sewing.

In the C portion shown in FIG. 6, the one-needle sewing is also performed during the single period set by the third number-of-stitches setting means 22.

In the two-needle sewing machine of the prior art, as described above, a bent seam is sewn in the cloth, and the amount of the cloth fed by a cloth feeding mechanism is little because, when the direction of the cloth is changed, a cloth presser is lifted. The cloth presser is moved downward to perform the one-needle sewing after the needles are stopped at the point 200. Therefore, compensation sewing must be performed with an auxiliary switch or the like because the number of the stitches between the points 100 and 200 is different from that of the stitches between the points 200 and 300.

Further, the sewing machine of the prior art has the disadvantage that it cannot be used in case the number of the stitches between the points 100 and 200 must be different form that of the stitches between the points 200 and 300 when a special corner portion is to be sewn.

SUMMARY OF THE INVENTION

An object of this invention is to solve the above problem. More specifically, the object of the invention is to obtain two-needle sewing in which it is not necessary to conform the stitches by the compensation sewing with the auxiliary switch or the like and special corner sewing patterns can be performed.

The two-needle sewing apparatus of the invention comprises a sewing machine including a needle bar mechanism capable for sewing with two needles separated from each other and for sewing with one of the needles by stopping the other needle. Changing means connected to the needle bar mechanism change the needle bar mechanism to the two-needle sewing condition or to one-needle operation of either the right or left needle. A plurality of selecting means select either the right or left needle with respect to a plurality of corner sewing portions when the changing means changes the needle bar mechanism to the one-needle sewing condition. Number-of-stitches setting means sets a sewing period of the one-needle sewing condition set by the changing means.

Control means control the sewing machine and the driving means of the sewing machine by receiving a command from the number-of-stitches setting means. Further, the number-of-stitches setting means includes a first number of stitches setting means for setting a number of stitches in the first part of one corner portion, and a second number-of-stitches means for setting a number of stitches in a second subsequent part of the corner portion. The second number-of-stitches setting means is independent of the first number-of-stitches setting means.

In the two-needle sewing apparatus of the invention, the control means control the sewing machine and the driving means operating the sewing machine by receiving the number-of-stitches setting signal from the number-of-stitches setting means. The control means set the numbers of stitches in the two respective sections. In one of the sections, the two-needle sewing is changed to one-needle sewing by the number-of-stitches setting means, and the one-needle sewing is performed to the corner. In the other section, the one needle sewing is again performed from the corner, and then the sewing is return to the two-needle sewing.

DETAILED DESCRIPTION OF THE PREFERRED EMBODIMENTS

Figure 4:
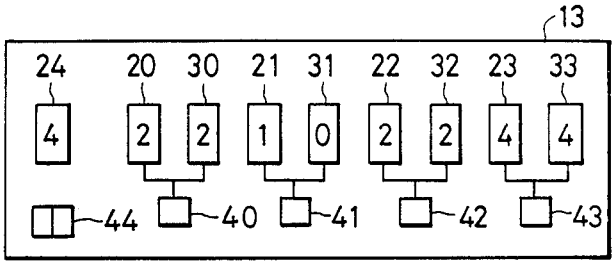
FIG. 4 shows an operating panel according to one embodiment of the invention.

An embodiment of the invention will be described hereinunder by referring to the attached drawings. In FIG. 4, within an operating panel 13 is shown a first number-of-stitches setting means 20 for the first section of the first corner portion. There are additionally provided similar first number-of-stitches setting means 21, 22 and 23 for the second, third and fourth corner portions respectively. A second number-of-stitches setting means 30 sets a second number of stitches for the second section of the first corner portion. Corresponding second number-of-stitches setting means 31, 32 and 33 are provided for the second, third and fourth corner portions.

A designating means 24 determines the total number of operative pairs of setting means in these four pairs of number-of-stitches setting means 20 to 23 and 30 to 33.

Figure 1:
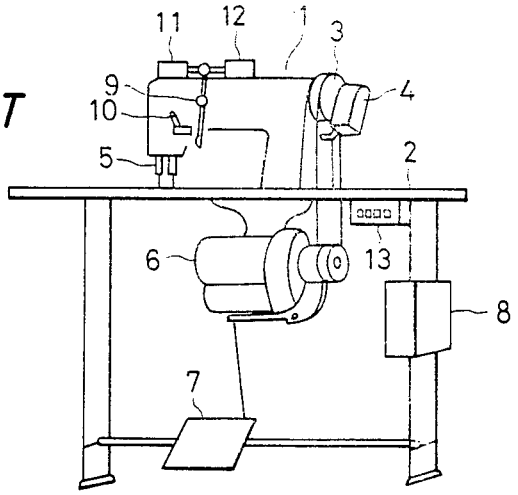
FIG. 1 PRIOR ART
FIG. 1 is a perspective diagram showing the complete sewing machine of the prior art.
Figure 2:
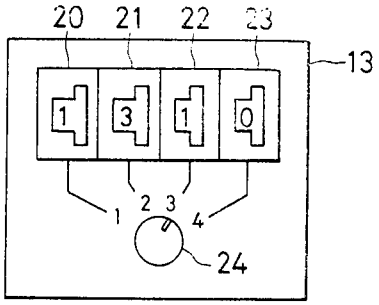
FIG. 2 PRIOR ART
FIG. 2 is a front view showing the operating panel of the sewing machine of FIG. 1.
Figure 3:
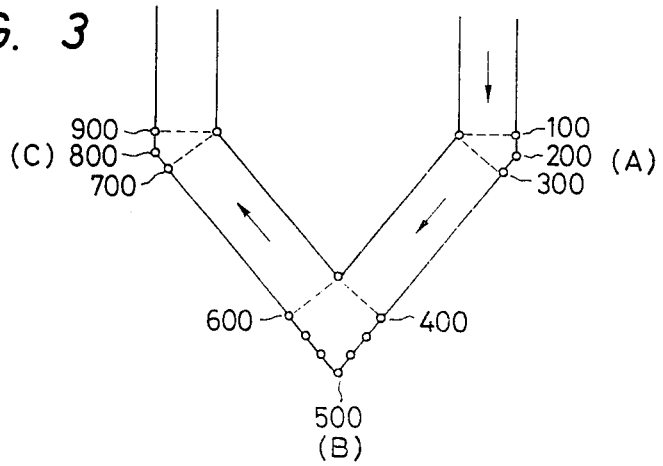
FIG. 3 is a diagram showing a sewing pattern sewn by the sewing machine of the prior art.
Figure 5:
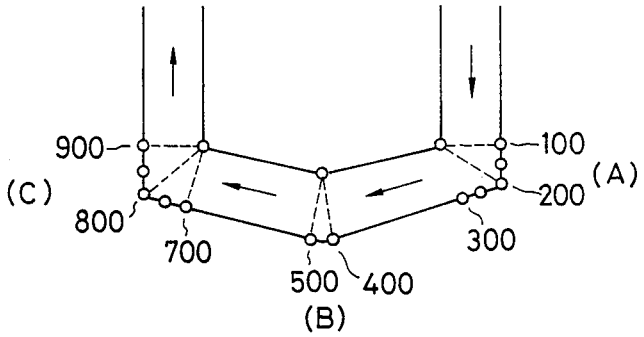
FIG. 5 is a diagram showing the example of a sewing pattern in this invention including a corner portion having an obtuse angle.

Further, corresponding selecting means 40 to 43 select one needle bar of the right or left needle bar used for the one-needle sewing in the first to fourth corner portions. Since other components are similar to the components of the prior art shown in FIG. 1, the description of these other components is omitted. FIG. 5 shows an example of a sewing pattern in which the needle is moved downward at the circle marks shown in FIG. 5 in order to perform the sewing.

In the embodiment of the invention, built as described above, if the sewing is performed along the sewing pattern of FIG. 5, the first number-of-stitches setting means 20 of the first section of the first corner portion is set to "2" because the number of stitches of one-needle sewing between the points 100 to 200 is two at the first corner portion (A portion). The second number-of-stitches setting means 30 of the first corner portion is set to "2" because the number of stitches between points 200 to 300 is also two.

The first number-of-stitches setting means 21 of the second corner portion is set to "1" because the number of stitches of one-needle sewing between the points 400 to 500 is 1 at the second corner portion (B portion). The second number-of-stitches setting means 31 of the second corner portion is set to "0" because two-needle sewing is performed after the needle is stopped at the point 500.

As described above, when the sewing is performed at the corner portion having an obtuse angle, the numbers of stitches of one needle sewings may be different from each other in the sections before and after the changing of the direction of a cloth.

Therefore, if a corner sewing signal is inputted to the control means when the needle is positioned at the point 400 in the B portion, the number of stitches is read from the first number-of-stitches setting means 21 for the second corner. Subsequently, one stitch of one-needle sewing is performed and the needle is stopped at the point 500.

Since the second number-of-stitches setting means 31 of the second corner is set to "0", the two-needle sewing is immediately performed, and no more one-needle sewing is performed.

The settings of the number-of-stitches for the third and fourth corner portions will not be described. Since they are similar to the corners already described.

Figure 6:
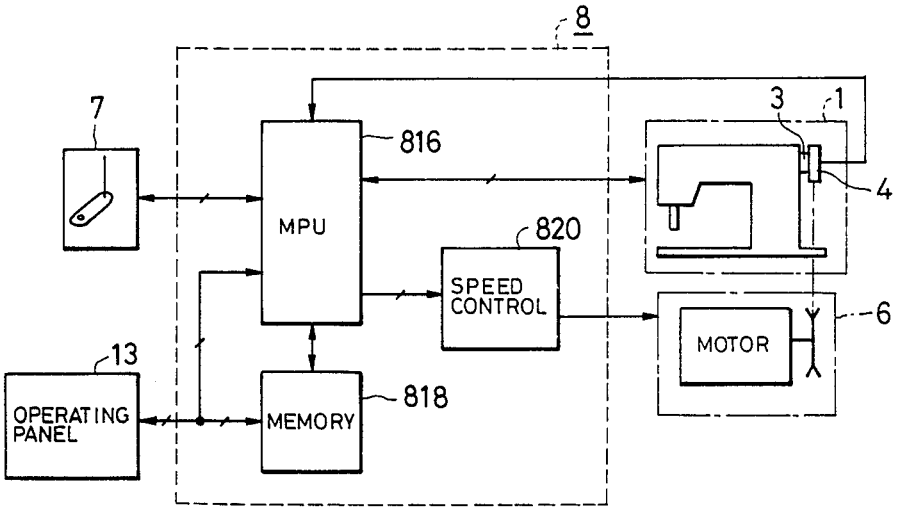
FIG. 6 shows the overall structure of one embodiment of the invention.

Next, the whole structure for the control of a sewing machine will be described with reference to FIG. 6. A switching means 7, represented by, for example, a treadle switch, commands the operation of the sewing machine 1. The panel 13 is shown in FIG. 4. A microprocessor 816 controls the driving of the sewing machine 1 on the basis of the command signal of the switching means 7 and the setting signals of the number-of-stitches setting means in the control panel 13. The microprocessor will be abbreviated to MPU hereafter. A memory 818 stores the various kinds of information required for the sewing. A speed control circuit 820 controls the speed as instructed by the MPU 816. A driving motor 6 has damping means, such as the clutch and the brake of the sewing machine 1. A detector 4, attached to a pulley 3 of the sewing machine 1, detects the up and down positions of the needles and the speed of the sewing machine needles. The detector 4 outputs to the MPU 816 detecting signals corresponding respectively to the up and down positions and the operating speed of the sewing machine needle to MPU 816.

The operation of the means described above will be described hereunder. Now, let us suppose that the sewing pattern as shown in FIG. 5 is selected, and each number of stitches is set by the number-of-stitches setting means 20, 30, 21 and 31 for the sections 100 to 200, 200 to 300, and 400 to 500, as described above.

First, the operating command signal is outputted to MPU 816 by treading the pedal in one direction and thus working the switching means 7. The MPU 816 reads the information from the number-of-stitches setting means 20 to 23 and 30 to 33, and stores the information in the memory 818. Then, the MPU 816 drives the driving motor 6 through the speed control circuit 820 at the predetermined constant speed in accordance with the stored information, and counts the number of stitches by receiving the needle down position signals as count signals outputted from the detector 4. Further, the MPU 816 controls the changing electromagnets 11 and 12 in the sewing machine 1. Therefore, the driving motor 6 is driven at the constant speed by the operating command signal of the switching means 7, and the two-needle sewing is started.

The down movement of the needles is stopped by returning the pedal 7 to the neutral position when the needles are positioned at the point 100 in the first corner portion A. When the corner sewing signal is outputted to the control means by treading the pedal 7 in the other direction (reverse direction), sewing with only the needle on one side (one-needle sewing) is performed by working the electromagnet 11 or 12 designated by the switch 10. During the time that one-needle sewing is performed between the points 100 and 200, two stitches are counted by the control means 8 receiving the count signals from the detector 4 and thereafter the down movement of the used needle is stopped. At the point 200, the direction of the cloth is changed, and then one-needle sewing is again started by the forward direction treading operation of the pedal 7. The one-needle sewing is again performed between the points 200 and 300. Then the sewing is returned to two-needle sewing by working the changing electromagnet 11 or 12 in the sewing machine 1 after two stitches are counted by counting the count signals from the position detector. The cloth is sewn at high speed from the point 300 to the point 400 located at the beginning of the second corner portion. The speed is determined by the degree of depression of the tread of the pedal 7. The cloth is again sewn with the designated number of stitches by the same operation described above, and each of subsequent corner portions are sewn.

In the above embodiment of the invention, the number of the corner that is being sewn at the present time is not necessarily apparent to the operator. Therefore, display means may be installed on the sewing system. The display means displays the number of the corner being sewn at the present time or displays whether the direction of the cloth is to be changed or not.

Furthermore, a mode switch 44 may be installed on the sewing system. The mode switch changes the control method from that of the invention to the prior art control method including only one number-of-stitches setting mechanism for each corner portion. In this situation, the second number-of-stitches setting means 30 to 33 are ignored and the contents of the first number-of-stitches setting means 20 to 23 are used by the MPU 816 for both of the sections around each corner.

Furthermore, in the above embodiment, the number of stitches set by the first number-of-stitches setting means is different than that of the stitches set by the second number-of-stitches setting means when the corner is an obtuse angle. Obviously, the numbers of stitches that are set can be arbitrary.

Although, in the described embodiment, the number of stitches is not set to "0" by the first number-of-stitches setting means, a regulating circuit may be installed for this case. The corner sewing is then inhibited by the regulating circuit when the number-of-stitches is set to 0 by the first number-of-stitches setting means.

As described above, according to the invention, different numbers of stitches can be set respectively in the portions of the seam immediately before and after cloth direction changing point in a corner portion. Therefore, the two-needle sewing machine operates well and without the necessity of auxiliary sewing if the number of stitches in the seam before the cloth changing point is different from that of the seam after the cloth changing point because the seam in the cloth is bent or the like. Further, such a two-needle sewing machine can be used when a specific corner such as the corner having an obtuse angle is sewn with one needle.

What is claimed is:

1. A two-needle sewing apparatus, comprising:

a sewing machine including a first needle and a second needle separated from each other and a needle bar mechanism for moving both of said needles in a two-needle sewing operation and for moving one of said needles while stopping the other of said needles in a one-needle sewing operation;

driving means for driving said sewing machine;

changing means connected to said needle bar mechanism for changing said needle bar mechanism between said two-needle operation and said one-needle operation;

a plurality of selecting means for selectively selecting one of said needles for a plurality of respective corner sewing portions when said changing means changes said needle bar mechanism to said one-needle sewing operation;

a plurality of corner setting means for setting timing of said one-needle sewing operation in said plurality of respective corner sewing portions, wherein each of said corner setting means includes first numerical setting means for setting a first sewing period in a first section of said corner sewing portion and second numerical setting means for setting a second sewing period in a second section of said corner sewing portion adjacent said first section, said second numerical setting means being independent of said first numerical setting means;

designating means for designating a total number of operable ones of said plurality of said corner setting means;

control means for controlling said sewing machine and said driving means in response to signals from said first and second numerical setting means and for stopping said driving means after said first sewing period; and a mode switch operatively associated with said control means and said corner setting means wherein said control means, in response to said mode switch being in a first position, sets said first sewing period from contents of said first numerical setting means and sets said second sewing period according to contents of said second numerical setting means, and in response to said mode switch being in a second position, sets said first and second sewing periods according to contents of one of said first and second numerical setting means.

* * * * *